US007973751B2

(12) United States Patent
Lee

(10) Patent No.: US 7,973,751 B2
(45) Date of Patent: Jul. 5, 2011

(54) DISPLAY DEVICE USING ADAPTED DOUBLE GAMMA CURVES

(75) Inventor: Jun-Pyo Lee, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 813 days.

(21) Appl. No.: 11/623,512

(22) Filed: Jan. 16, 2007

(65) Prior Publication Data

US 2008/0036718 A1 Feb. 14, 2008

(30) Foreign Application Priority Data

Feb. 23, 2006 (KR) ..... 10-2006-0017511

(51) Int. Cl.
*G09G 3/36* (2006.01)

(52) U.S. Cl. ..... 345/89; 345/690

(58) Field of Classification Search ..... None
See application file for complete search history.

(56) References Cited

U.S. PATENT DOCUMENTS 5,847,688 A * 12/1998 Ohi et al. ..... 345/98
5,936,596 A * 8/1999 Yoshida et al. ..... 345/9
2003/0025664 A1* 2/2003 Koga et al. ..... 345/89
2003/0034939 A1* 2/2003 Moon ..... 345/76
2003/0122761 A1* 7/2003 Hong ..... 345/89
2003/0146893 A1* 8/2003 Sawabe ..... 345/89
2004/0012554 A1* 1/2004 Song et al. ..... 345/92
2004/0021677 A1* 2/2004 Sasaki et al. ..... 345/694
2005/0057473 A1* 3/2005 Hsu et al. ..... 345/89
2006/0007091 A1 1/2006 Yang et al.
2006/0103615 A1* 5/2006 Shih et al. ..... 345/88

FOREIGN PATENT DOCUMENTS

CN 1573459 2/2005

OTHER PUBLICATIONS

Extended European Search report dated Mar. 25, 2009 for European Application No. EP 07002020.
Sang Soo Kim, Development Center et al., "66.1: Invited Paper: The World Largest (82-in) TFT-LCD" SID Digest pp. 1842-1847.

* cited by examiner

*Primary Examiner* — Alexander Eisen
*Assistant Examiner* — Matthew Yeung
(74) *Attorney, Agent, or Firm* — F. Chau & Associates, LLC

(57) ABSTRACT

A display panel has a high pixel and a low pixel that are formed in a pixel area. A driving section receives a first image signal from an external device, outputs a second image signal to the high pixel using gamma data that corresponds to a high pixel gamma curve, and outputs a third image signal to the low pixel using gamma data that corresponds to a Sow pixel gamma curve. A driving section outputs the third image signal to the low pixel using the same gamma data for RGB data that correspond to a low gradation of the low pixel gamma curve.

12 Claims, 8 Drawing Sheets

| GRAY | RED | | GREEN | | BLUE | |
|---|---|---|---|---|---|---|
| | A | B | A | B | A | B |
| 0 | 0 | 0 | 0 | 0 | 0 | 0 |
| 1 | 21 | 0 | 21 | 0 | 21 | 0 |
| 2 | 36 | 0 | 36 | 0 | 36 | 0 |
| 3 | 48 | 0 | 48 | 0 | 48 | 0 |
| 4 | 63 | 0 | 61 | 0 | 61 | 0 |
| 5 | 76 | 0 | 72 | 0 | 69 | 0 |
| 6 | 87 | 0 | 84 | 0 | 81 | 0 |
| 7 | 98 | 0 | 95 | 0 | 92 | 0 |
| 8 | 109 | 0 | 106 | 0 | 103 | 0 |
| 9 | 119 | 0 | 116 | 0 | 113 | 0 |
| 10 | 128 | 0 | 126 | 0 | 124 | 0 |
| 11 | 136 | 0 | 134 | 0 | 132 | 0 |
| 12 | 146 | 0 | 143 | 0 | 141 | 0 |
| ⋮ | | | | | | |
| 246 | 1017 | 978 | 1017 | 972 | 1017 | 957 |
| 247 | 1017 | 978 | 1017 | 978 | 1017 | 964 |
| 248 | 1017 | 978 | 1017 | 985 | 1017 | 973 |
| 249 | 1017 | 978 | 1017 | 991 | 1017 | 982 |
| 250 | 1016 | 1000 | 1016 | 997 | 1016 | 989 |
| 251 | 1016 | 1005 | 1016 | 1002 | 1016 | 997 |
| 252 | 1016 | 1009 | 1016 | 1007 | 1016 | 1004 |
| 253 | 1016 | 1013 | 1016 | 1012 | 1016 | 1010 |
| 254 | 1016 | 1016 | 1016 | 1016 | 1016 | 1015 |
| 255 | 1020 | 1020 | 1020 | 1020 | 1020 | 1020 |

FIG. 7

| GRAY | RED | | GREEN | | BLUE | |
|---|---|---|---|---|---|---|
| | A | B | A | B | A | B |
| 0 | 0 | 0 | 0 | 0 | 0 | 0 |
| 1 | 21 | 0 | 21 | 0 | 21 | 0 |
| 2 | 36 | 0 | 36 | 0 | 36 | 0 |
| 3 | 48 | 0 | 48 | 0 | 48 | 0 |
| 4 | 63 | 0 | 61 | 0 | 61 | 0 |
| 5 | 76 | 0 | 72 | 0 | 69 | 0 |
| 6 | 87 | 0 | 84 | 0 | 81 | 0 |
| 7 | 98 | 0 | 95 | 0 | 92 | 0 |
| 8 | 109 | 0 | 106 | 0 | 103 | 0 |
| 9 | 119 | 0 | 116 | 0 | 113 | 0 |
| 10 | 128 | 0 | 126 | 0 | 124 | 0 |
| 11 | 136 | 0 | 134 | 0 | 132 | 0 |
| 12 | 146 | 0 | 143 | 0 | 141 | 0 |
| ⋮ | | | | | | |
| 246 | 1017 | 978 | 1017 | 972 | 1017 | 957 |
| 247 | 1017 | 978 | 1017 | 978 | 1017 | 964 |
| 248 | 1017 | 978 | 1017 | 985 | 1017 | 973 |
| 249 | 1017 | 978 | 1017 | 991 | 1017 | 982 |
| 250 | 1016 | 1000 | 1016 | 997 | 1016 | 989 |
| 251 | 1016 | 1005 | 1016 | 1002 | 1016 | 997 |
| 252 | 1016 | 1009 | 1016 | 1007 | 1016 | 1004 |
| 253 | 1016 | 1013 | 1016 | 1012 | 1016 | 1010 |
| 254 | 1016 | 1016 | 1016 | 1016 | 1016 | 1015 |
| 255 | 1020 | 1020 | 1020 | 1020 | 1020 | 1020 |

DISPLAY DEVICE USING ADAPTED DOUBLE GAMMA CURVES

CROSS-REFERENCE TO RELATED APPLICATION

This application claims priority to Korean Patent Application No. 2006-17511 filed on Feb. 23, 2006, the disclosure of which is incorporated by reference in its entirety.

BACKGROUND OF THE INVENTION

1. Technical Field

The present disclosure relates to a display device, and more particularly, to a display device having an improved side visibility.

2. Discussion of the Related Art

A liquid crystal display ("LCD") apparatus can include two substrates and a liquid crystal layer interposed between the two substrates. The liquid crystal layer varies arrangement of liquid crystal molecules in response to an electric field applied thereto, thus light transmitted through the liquid crystal layer may be changed to display an image.

The liquid crystal layer of the LCD device has anisotropy so that an image display quality of the LCD device varies based on a viewing angle. The LCD device may have a narrow range of a viewing angle than other display devices to show an image of good display quality. Therefore, in order to improve a wide viewing angle, a vertically aligned ("VA") mode LCD device has been developed.

The VA mode LCD device includes a liquid crystal layer having a negative type anisotropic dielectric constant. The liquid crystal layer is seated between two substrates. The two substrates are vertically aligned with each other. Liquid crystal molecules of the liquid crystal layer have hometropic characteristics.

When an electric field is not applied to the two substrates, the liquid crystal molecules are substantially vertically arranged with respect to the two substrates such that a black image is displayed.

When a relatively high electric field is applied to the two substrates, the liquid crystal molecules are substantially perpendicularly arranged with respect to the two substrates such that a white image is displayed. Furthermore, when an electric field that is less than the high electric field is applied to the two substrates, the liquid crystal molecules are slantly arranged with respect to the two substrates such that a gray image is displayed.

A relatively small sized LCD device can have a narrow viewing angle and a gray inversion-based viewing angle. The LCD device employs a patterned vertical alignment ("PVA") mode to enhance display quality.

The PVA mode LCD device may include a countering substrate having a common electrode layer that is patterned to define multi-domains, and an array substrate having a patterned pixel electrode layer to define multi-domains.

SUMMARY OF THE INVENTION

Embodiments of the present invention provide a display device capable of enhancing a side visibility by preventing color coordinate values of gradations from being different in a side and a front.

In an exemplary embodiment of the present invention, the display device includes a display panel and a driving section. The display panel has high and low pixels that are formed in a pixel area. The driving section receiving a first image signal from an external device outputs a second image signal to the high pixel using gamma data that corresponds to a high pixel gamma curve, and outputs a third image signal to the low pixel using gamma data in response to a low pixel gamma curve. The driving section outputs the third image signal to the low pixel using the same gamma data for each of the RGB data that correspond to a low gradation of the low pixel gamma curve.

The driving section may include a timing controller, a gate driver and a data driver. The timing controller generates the second and third image signals based on the first image signal. The gate driver outputs a plurality of gate signals. The gate signals activate a plurality of gate lines that are formed in the display panel. The data driver compensates the second image signal that is provided from the timing controller using the gamma data that correspond to the high pixel gamma curve. The data driver compensates the third image signal that is provided from the timing controller using the gamma data that correspond to the low pixel gamma curve. The data driver outputs the compensated second and third image signals to the display panel.

The driving section may include a timing controller, a first gate driver, a second gate driver and a data driver. The timing controller generates the second image signal based on the first image signal. The first gate driver outputs a plurality of gate signals. The gate signals activate even-numbered gate lines that are formed in the display panel. The second gate driver outputs a plurality of gate signals. The gate signals activate odd-numbered gate lines that are formed in the display panel. The data driver outputs the second image signal provided from the timing controller to the display panel.

In an exemplary embodiment of the present invention, the display device may include a display panel, a storing section, a timing controller, a gate driver and a data driver. The display panel has high and Sow pixels that are formed in a pixel area. The pixel area is defined by two adjacent gate lines, an odd numbered data line and an even numbered data Sine that is adjacent to the odd numbered data line. The storing section stores high RGB gamma data corresponding to the high pixel and low RGB gamma data corresponding to the low pixel. The timing controller receiving a first image signal from an external device outputs a second image signal adapted the first image signal to the high RGB gamma data, and outputs a third image signal adapted the first image signal to the low RGB gamma data. The gate driver outputs a gate signal. The gate signal activates the gate line in response to a controlling of the timing controller. The data driver outputs the second and third image signals to the data line in response to a controlling of the timing controller. The storing section stores same RGB gamma data, which corresponds to a low-gradation of the low RGB gamma data.

In an embodiment, the low gradation may be about 10% of a full-gradation.

In an exemplary embodiment of the present invention, the display device may include a display panel, a first storing section, a second storing section, a timing controller, a switching section, a first gate driver, a second gate driver and a data driver. The display panel has high and low pixels that are formed in a pixel area. The pixel area is defined by two adjacent gate lines and two adjacent data lines. The first storing section stores high RGB gamma data corresponding to high pixel gamma curves of RGB data, respectively. The second storing section stores low RGB gamma data corresponding to low pixel gamma curves of RGB data, respectively. The timing controller receiving a first image signal from an external device generates a second image signal based on the first image signal. The switching section selectively outputs the high RGB gamma data and the low RGB gamma data in response to a controlling of the timing controller. The first gate driver outputs a first gate signal. The first gate signal activates an even-numbered gate line of the display panel. The second gate driver outputs a second gate signal. The the second gate signal activates an odd-numbered gate line of the display panel. The data driver compensates the second image signal using the high RGB gamma data and the low RGB gamma data, and outputs the compensated second image signal to the display panel. The second storing section stores the same RGB gamma data, which corresponds to a low-gradation of the low RGB gamma data.

In an impediment, the low gradation may be about 10% of a full-gradation.

According to exemplary embodiments of the present invention, the high pixel and low pixel gamma curves are independently adjusted in the LCD device that is adapted the double gamma curves, especially the RGB gamma curves corresponding to a low-gradation of a low pixel gamma curve match with each other, so that the occurrence of a display error being observed a yellowish at a side of the LCD device is prevented.

BRIEF DESCRIPTION OF THE DRAWINGS

Exemplary embodiments of the present invention can be understood in more detail from the following descriptions taken in conjunction with the accompanying drawings, in which;

FIG. 7 is a table for describing an example of each RGB gamma look-up-table (LUT) corresponding to a high pixel and a low pixel that are extracted and set according to an exemplary embodiment of the present invention.

DESCRIPTION OF THE EXEMPLARY EMBODIMENTS

Exemplary embodiments of the invention are described more fully hereinafter with reference to the accompanying drawings. This invention may, however, be embodied in many different forms and should not be construed as limited to the embodiments set forth herein.

A super patterned vertical alignment ("SPVA") mode LCD device increases a viewing angle of the LCD device, which has a main pixel and a sub pixel that are formed in a pixel area of the LCD device. Each of the main pixel and the sub pixel receives a different pixel voltage from each other.

In the SPVA mode LCD device, each of the main and sub pixels has a different distribution of liquid crystal molecules, so that a side visibility of the SPVA mode LCD device is enhanced.

However, when the SPVA mode LCD device is observed from a side, a yellowing color can be observed. For example, it can be observed that color coordinate values of each gradation corresponding to a side of the SPVA mode LCD device and that of each gradation corresponding to a front of the SPVA mode LCD device are different from each other.

Figure 1A:
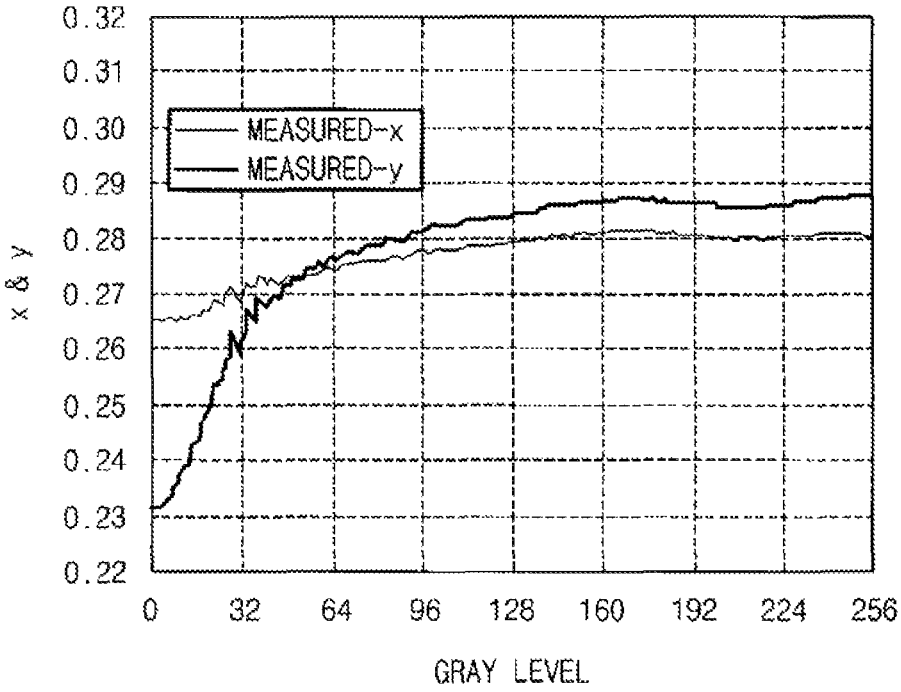
FIGS. 1A and 1B are graphs showing a variation of color coordinates when viewing from a front and a side of an SPVA mode LCD device.
Figure 1B:
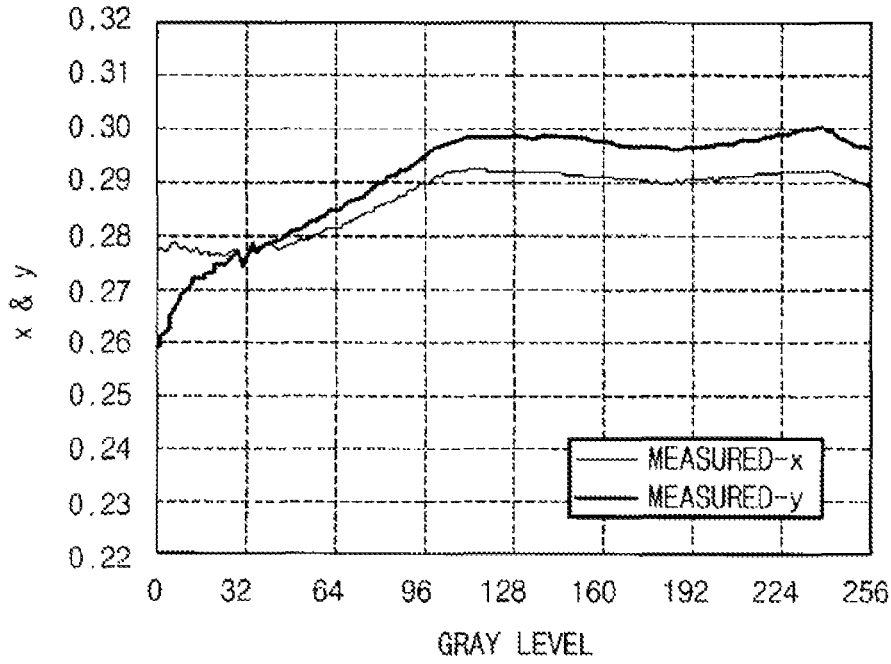

FIGS. 1A and 1B are graphs showing a variation of color coordinates when viewing from a front and a side of an SPVA mode LCD device.

Referring to FIG. 1A, as a gradation varies, an X-color coordinate corresponding to a front of the SPVA mode LCD device is plotted from about 0.265 to about 0.28, and a Y-color coordinate corresponding to a front of the SPVA mode LCD device is plotted from about 0.23 to about 0.288.

The above description is summarized as following Table 1.

TABLE 1

| | gradation | | | | | | | | |
|---|---|---|---|---|---|---|---|---|---|
| | 0 | 32 | 64 | 96 | 128 | 160 | 192 | 224 | 256 |
| X-color coordinate | 0.265 | 0.270 | 0.275 | 0.278 | 0.280 | 0.280 | 0.280 | 0.280 | 0.280 |
| Y-color coordinate | 0.230 | 0.260 | 0.277 | 0.282 | 0.285 | 0.285 | 0.287 | 0.287 | 0.288 |

Alternatively, as a gradation varies, an X-color coordinate corresponding to a side of the LCD device is plotted from about 0.27 to about 0.29, and a Y-color coordinate corresponding to a side of the LCD device is plotted from about 0.26 to about 0.3.

The above description is summarized as following Table 2.

TABLE 2

| | Gradation | | | | | | | | |
|---|---|---|---|---|---|---|---|---|---|
| | 0 | 32 | 64 | 96 | 128 | 160 | 192 | 224 | 256 |
| X-color coordinate | 0.278 | 0.278 | 0.282 | 0.290 | 0.292 | 0.292 | 0.290 | 0.292 | 0.290 |
| Y-color coordinate | 0.260 | 0.276 | 0.285 | 0.295 | 0.299 | 0.298 | 0.296 | 0.230 | 0.296 |

When Table 1 and Table 2 are compared to each other, a color coordinate value of each of the gradations corresponding to a side of the LCD device is greater than that of each of the gradations corresponding to a front of the LCD device. The relatively high color coordinate value represents that more yellow components are included in the LCD device.

A color coordinate value of the gradations at a front of the LCD device is different from a color coordinate value of the gradations at a side of the LCD device, due to the difference of each of RGB gamma data.

Figure 2A:
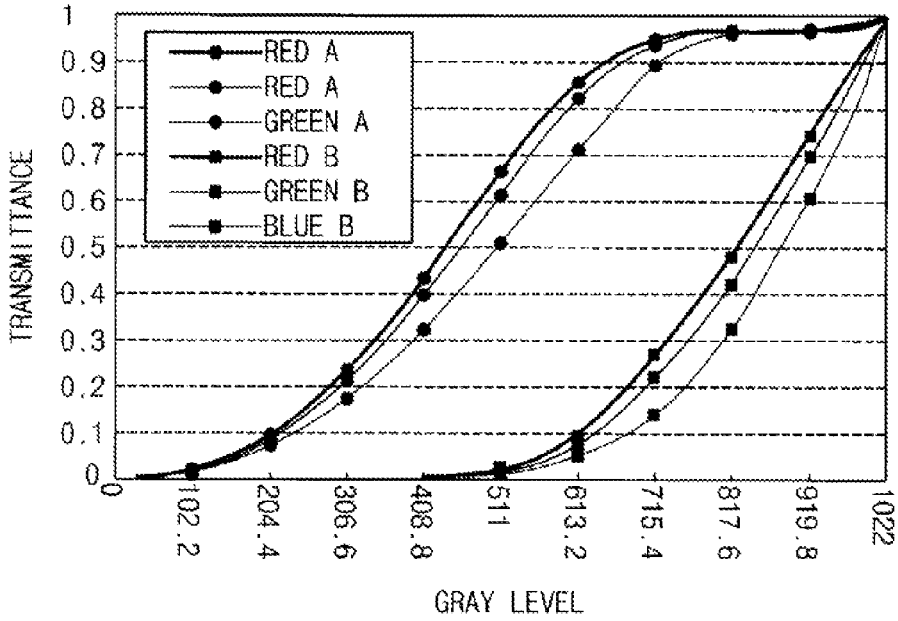
FIG. 2A is a graph showing conventional double gamma curves.
Figure 2B:
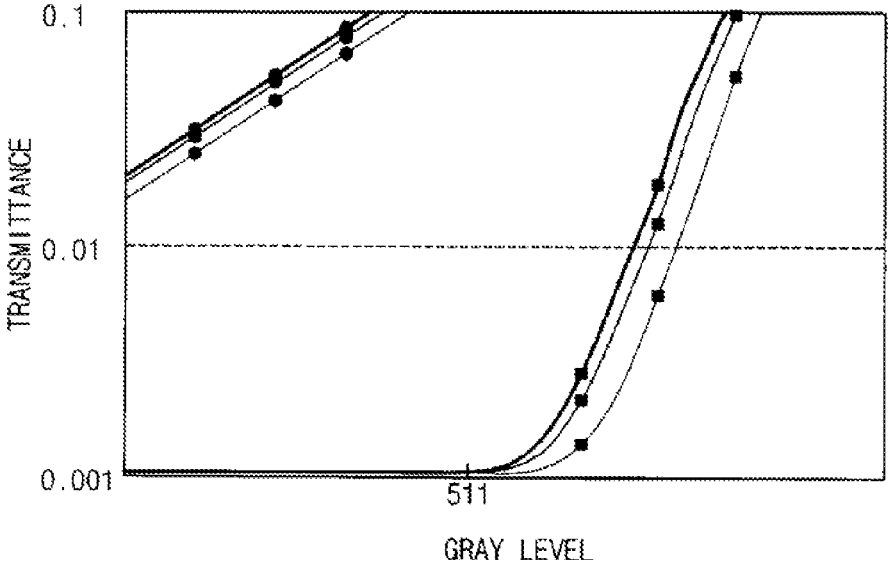
FIG. 2B is an enlarged view showing part of 'A' of FIG. 2A according to an exemplary embodiment of the present invention.

FIG. 2A is a graph showing conventional double gamma curves. FIG. 2B is an enlarged view part of 'A' of FIG. 2A according to an exemplary embodiment of the present invention.

Referring to FIGS. 2A and 2B, RGB gamma data that corresponds to a low pixel gamma curve of the double gamma curves are different from each other. The low pixel gamma curve determines a side visibility of the SPVA mode LCD device. As shown in FIG. 2A, a red gamma curve (RED B), a green gamma curve (GREEN B) and a blue gamma curve (BLUE B) of the low pixel gamma curve are different from each other in a low-gradation, in particular a black-gradation. A difference of the red, green and blue gamma curves induces a color variation at a side of the SPVA mode LCD device.

Figure 3:
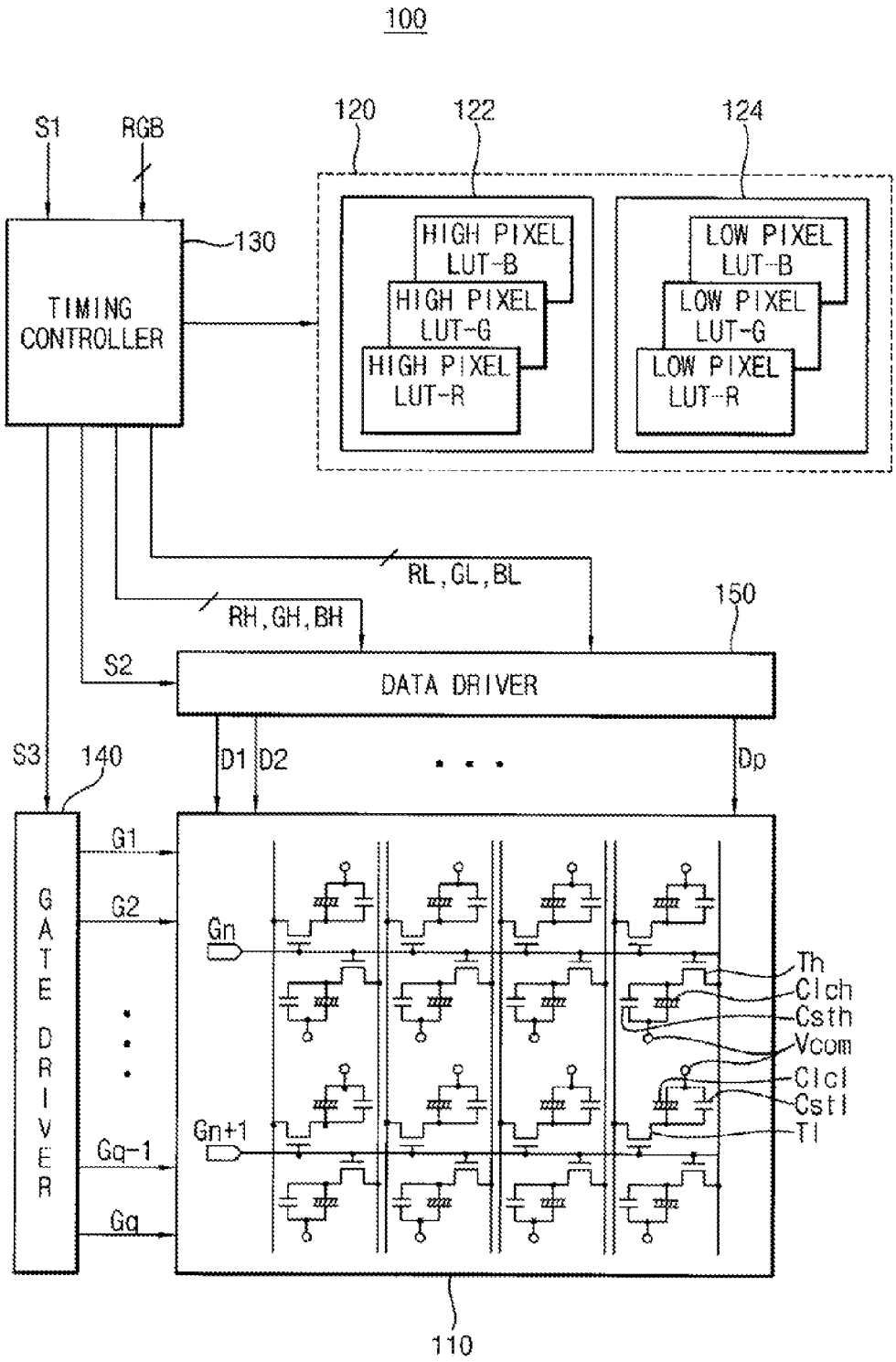
FIG. 3 is a block diagram showing an LCD device according to an exemplary embodiment of the present invention.

FIG. 3 is a block diagram showing an LCD device according to an exemplary embodiment of the present invention.

Referring to FIG. 3, an LCD device 100 according to an exemplary embodiment of the present invention includes an LCD panel 110, a storing section 120, a timing controller 130, a gate driver 140 and a data driver 150.

The LCD panel 110 may include high and low pixels that are defined by gate lines adjacent to each other, odd numbered data lines DL and even numbered data lines DL that are adjacent to the odd numbered data lines DL.

The high pixel may include a first switching element Th, a first liquid crystal capacitor Clch and a first storage capacitor Csth. The first switching element Th is electrically connected to one of the gate lines and to an even numbered data line DL. The first liquid crystal capacitor Clch and the first storage capacitor Csth are electrically connected to the first switching element Th.

The low pixel may include a second switching element Tl, a second liquid crystal capacitor Clcl and a second storage capacitor Cstl. The second switching element Tl is electrically connected to a remaining gate line that is adjacent to the gate line connected to the first switching element Tl and to an odd numbered data line DL, The second liquid crystal capacitor Clcl and the second storage capacitor Cstl are electrically connected to the second switching element Tl.

The storing section 120 may include a first storing section 122 storing RGB gamma data corresponding to the high pixel and a second storing section 124 storing RGB gamma data corresponding to the low pixel.

The first storing section 122 may include a first look-up-table ("LUT") storing R gamma data corresponding to the high pixel, a second look-up-table storing G gamma data corresponding to the high pixel and a third look-up-table storing B gamma data corresponding to the high pixel.

Figure 4:
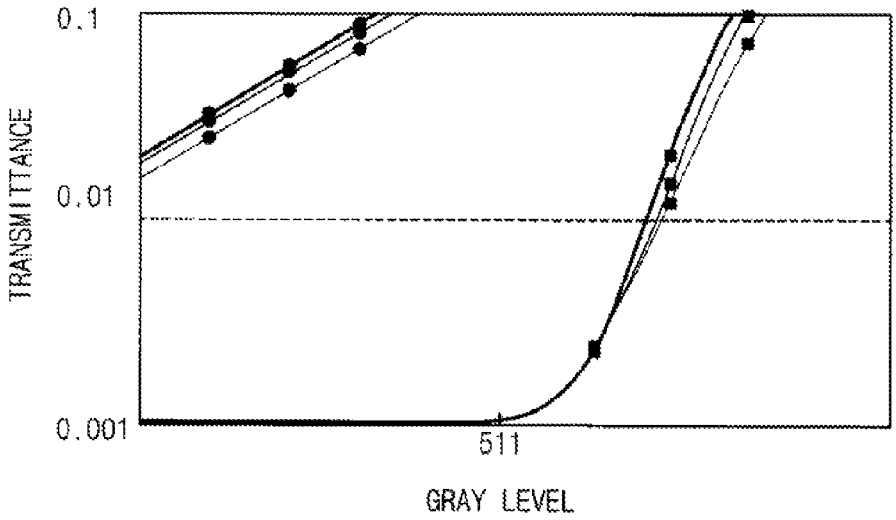
FIG. 4 is an enlarged view of a graph showing a gray level in relation to a transmissive rate according to an exemplary embodiment of the present invention.

The second storing section 124 may include a fourth look-up-table ("LUT") storing R gamma data corresponding to the low pixel, a fifth look-up-table storing G gamma data corresponding to the low pixel and a sixth look-up-table storing B gamma data corresponding to the low pixel. Particularly, same RGB gamma data are stored in the second storing section 124, as shown in FIG. 4, which corresponds to a low-gradation among the RGB gamma data corresponding to the low pixel. The low-gradation is about 10% of a full-gradation.

The timing controller 130 receives a first image signal R, G and B and a first timing signal S1 from a host system such as an external graph controller (not shown). The first timing signal S1 may include a horizontal synchronizing signal Hsync, a vertical synchronizing signal Vsync, a data enable signal DE and a main clock signal MCLK.

The horizontal synchronizing signal Hsync represents a time required to display one line of the field. The vertical synchronizing signal Vsync represents a time required to display one frame field. Thus, the horizontal synchronizing signal Hsync includes pulses corresponding to the number of pixels included in one line. The data enable signal DE represents a time required to supply the pixel with data.

The timing controller 130 outputs a second image signal RH, GH and BH and a second timing signal S2, which have been processed for the RGB gamma data corresponding to the high pixel. The second timing signal S2 includes a load signal LOAD and a start of horizontal signal STH.

The timing controller 130 outputs a third image signal RL, GL and BL and a third timing signal S3, which have been processed for the RGB gamma data corresponding to the low pixel. The third timing signal S3 includes a gate clock signal Gate Clk (CPV or GCLK) and a start of vertical signal STV.

The gate driver 140 outputs gate signals G1, G2, . . . , Gq−1 and Gq that activates the gate lines GL in response to the third timing signal S3 outputted from the timing controller 130.

The data driver 150 transforms each of the second and third image signals RH, GH, BH, RL, GL and BL into a plurality of data voltages D1, D2, . . . , Dp−1 and Dp in response to the second timing signal S2 that is provided from the timing controller 130, and outputs the transformed data voltages D1, D2, . . . , Dp−1 and Dp to the data lines DL, respectively. The data voltages D1, D2, . . . , Dp−1 and Dp have a relatively inverting polarity for a polarity of a common voltage Vcom.

When a polarity of the common voltage is a low level, a polarity of the data voltages D1, D2, . . . , Dp−1 and Dp is a high level with respect to the common voltage Vcom. Alternatively, when a polarity of the common voltage is a high level, a polarity of the data voltages D1, D2, . . . , Dp−1 and Dp is a low level with respect to the common voltage Vcom.

The LCD device 100 may include a power generating section (not shown) that provides the gate driver 140 with gate on/off voltages VON/VOFF in response to a fourth timing signal (not shown) provided from the timing controller 130.

The power generating section provides a common voltage Vcom to the first and second liquid crystal capacitors Clch and Clcl of the LCD panel 110 in synchronize with the gate signals G1, G2, . . . , Gq−1 and Gq.

As described above, a low-gradation of a low pixel gamma curve, particularly a plurality of RGB gamma curves corresponding to a black gradation is matched with each other, so that display defects such as yellowing is prevented, which may be observed at a side of the LCD device, which is generated by differentiating between color coordinates of each gradation at a side viewing and that of each gradation at a front viewing.

Figure 5:
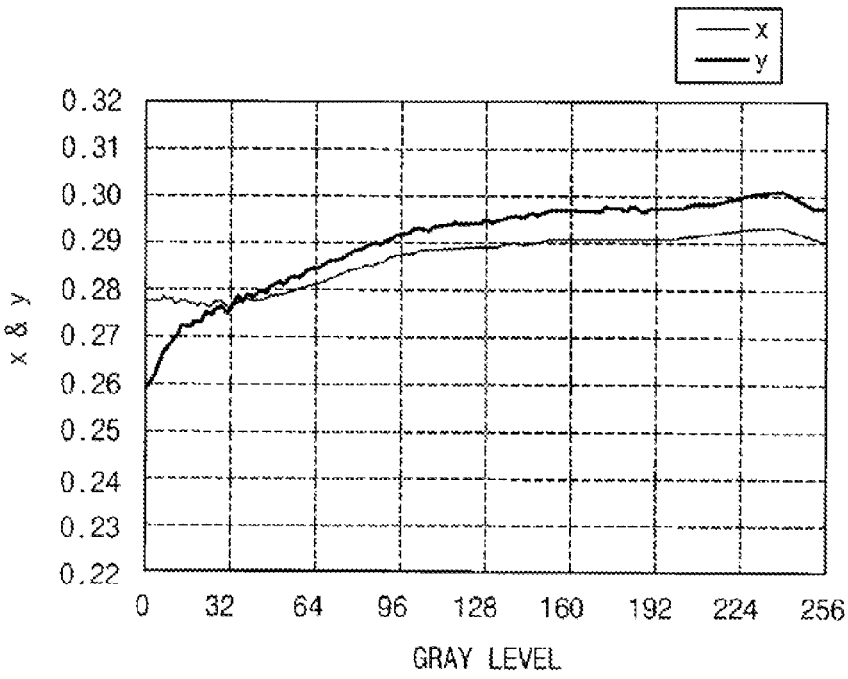
FIG. 5 is a graph showing color coordinates when viewing from a side of an LCD device according to an exemplary embodiment of the present invention.

FIG. 5 is a graph showing color coordinates of a side view of an exemplary embodiment of the present invention.

Referring to FIG. 5, as varying of a gradation, an X-color coordinate corresponding to a side of the LCD device is plotted from about 0.278 to about 0.294, and a Y-color coordinate corresponding to a side of the LCD device is plotted from about 0.26 to about 0.293.

The above description was summarized as following Table 3.

TABLE 3

| | gradation | | | | | | | | |
|---|---|---|---|---|---|---|---|---|---|
| | 0 | 32 | 64 | 96 | 128 | 160 | 192 | 224 | 256 |
| X-color | 0.278 | 0.276 | 0.282 | 0.286 | 0.289 | 0.290 | 0.290 | 0.294 | 0.290 |
| Y-color | 0.260 | 0.276 | 0.282 | 0.287 | 0.289 | 0.290 | 0.290 | 0.293 | 0.290 |

When the Table 2 and Table 3 are compared to each other, as varying of a gradation, an X-color coordinate value of each of gradations, which is observed at a side of the LCD device according to an exemplary embodiment of the present invention, is smaller than that of each of gradations, which is observed at a side of the conventional LCD device. Therefore, an occurrence of a yellowish is prevented. The yellowish occurred when an X-color coordinate value corresponding to a side of the LCD is relatively higher than an X-color coordinate value corresponding to a front of the LCD.

Also, as varying of a gradation, a Y-color coordinate value of each of gradations, which is observed at a side of the LCD device according to an exemplary embodiment of the present invention, is smaller than that of each of gradations that is observed at a side of the conventional LCD device. Therefore, an occurrence of a yellowish is prevented. The yellowish occurred when a Y-color coordinate value corresponding to a side of the LCD is relatively higher than a Y-color coordinate value corresponding to a front of the LCD.

Figure 6A:
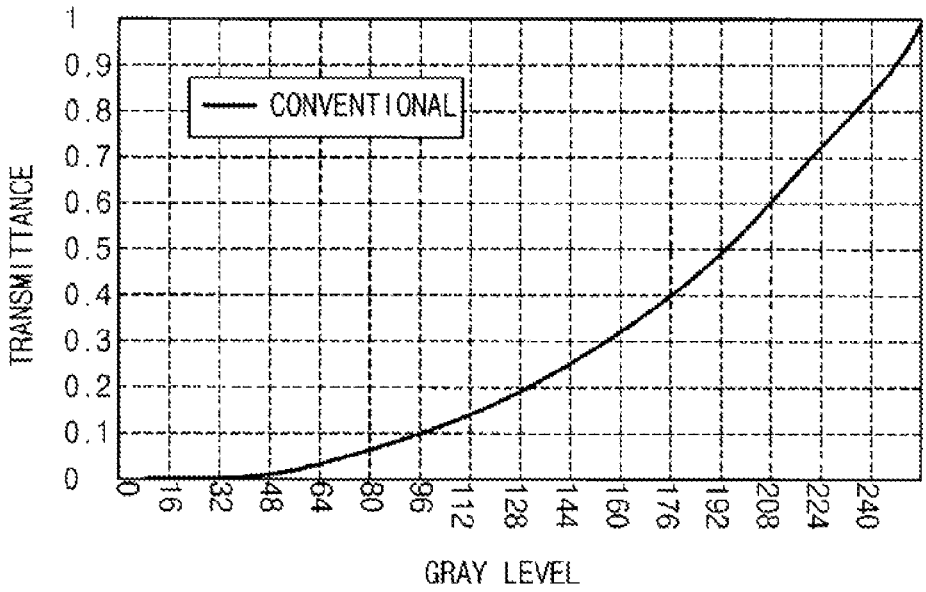
FIG. 6A is a graph showing a conventional gamma curve.
Figure 6B:
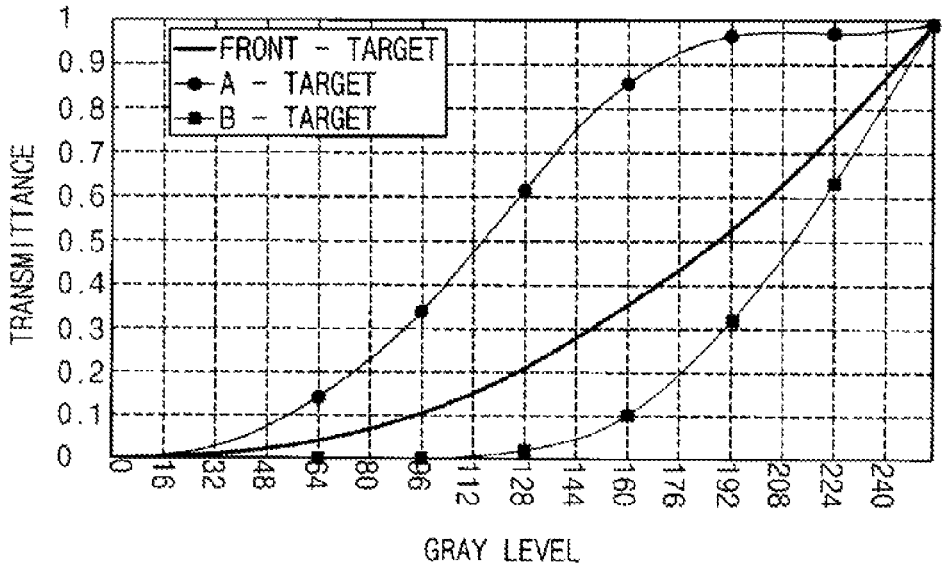
FIG. 6B is a graph showing a setting of a high pixel target gamma curve and a low pixel target gamma curve.
Figure 6C:
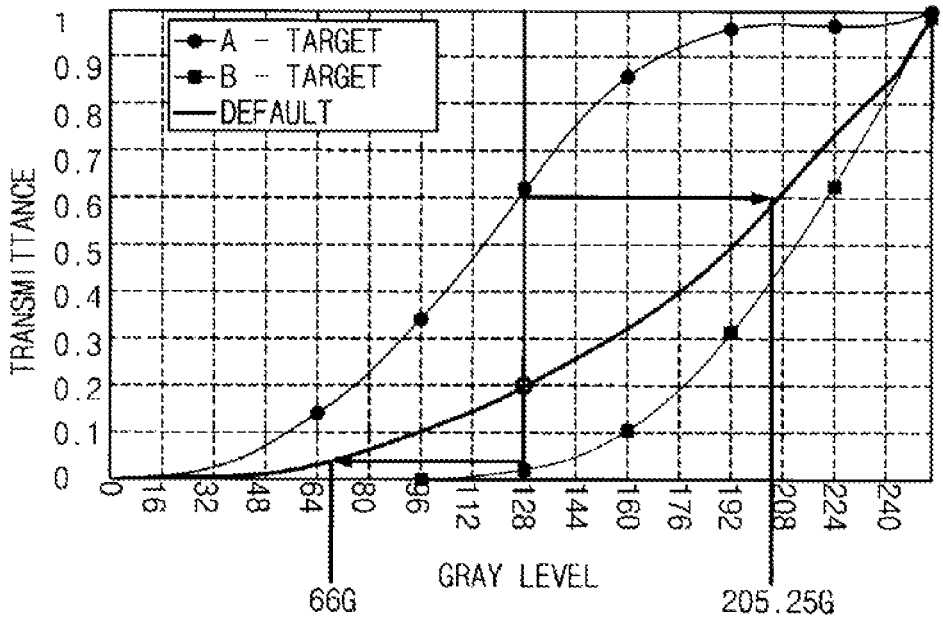
FIG. 6C is a graph showing an extracting operation of gradation data corresponding to a luminance that is approximated with the high and low pixel target values from the gamma curve to extract a gamma look-up-table ("LUT") according to an exemplary embodiment of the present invention.

FIG. 6A is a graph showing a conventional gamma curve. FIG. 6B is a graph showing a setting of a high pixel target gamma curve and a low pixel target gamma curve. FIG. 6C is a graph showing an extracting operation of gradation data corresponding to a luminance, which is approximated with the high and low pixel target values from the conventional gamma curve to extract a gamma look-up-table (LUT) according to an exemplary embodiment of the present invention.

Referring to FIG. 6A, when a same voltage is applied into each of the high and low pixels of the LCD device, a plurality of luminance data corresponding to gradations are extracted based on the conventional gamma curve. A plurality of bits of the luminance data that correspond to gradations are extended using a dithering method to generate LUTs corresponding to the high pixel and the low pixel, respectively.

For example, a 90.25-gradation, a 90.5-gradation and a 90.75-gradation are existed between about 90-gradation and about 91-gradation that are defined by 8 bits. When the 90.25-gradation, the 90.5-gradation and the 90.75-gradation are bit-extended using a dithering method, the 90-gradation is transformed into a 360-gradation and the 90.25-gradation is transformed into a 361-gradation. Also, the 90.5-gradation is transformed into a 362-gradation, the 90.75-gradation is transformed into a 363-gradation, and the 91-gradation is transformed into a 364-gradation.

Referring to FIG. 6B, to optimize a side visibility of the LCD device, a gamma curve (B-TARGET) corresponding to a target low pixel is established, and then a gamma curve (A-TARGET) corresponding to a target high pixel is established in accordance with a front target gamma curve (front-TARGET).

Referring to FIG. 6C, a gradation value corresponding to a luminance, which is approximated with the target high pixel gamma curve and the target low pixel gamma curve of each gradations, is extracted from the plurality of bit extended conventional gamma data. The extracted gradation values are stored with a look-up-table ("LUT") type.

When the conventional gamma data is about 128-gradation, a transmittance that is mapped in a gamma curve corresponding to the high pixel is 205.25-gradation in the conventional gamma curve. The 205.25-gradation is 8 bits so that the 205.25-gradation is mapped to 821-gradation through a bit extending process of 10 bits.

When the conventional gamma data is about 128-gradation, a transmittance that is mapped in a gamma curve corresponding to the low pixel is 66-gradation in the conventional gamma curve. The 66-gradation is 8 bits so that the 66-gradation is mapped to 264-gradation through a bit extending process of 10 bits.

The above process is independently performed with respect to RGB data, so that a gamma tuning for each of the RGB data is possible.

FIG. 7 is a table for describing one example of each RGB gamma look-up-tables (LUTs) corresponding to a high pixel and a low pixel that are extracted and set in accordance with an exemplary embodiment of the present invention.

Referring to FIG. 7, a high pixel gamma data (shown in 'A' column) and a low pixel gamma data (shown in 'B' column) that correspond to each RGB of gradations are established.

RGB gamma data corresponding to a low-gradation of a RGB gamma data corresponding to the high pixel are increased as a gradation is increased. However, RGB gamma data corresponding to a low-gradation of a RGB gamma data corresponding to the low pixel are same even though a gradation is increased.

In FIG. 7, RGB gamma data corresponding to a tow-gradation of RGB gamma data corresponding to a low pixel are '0'. A range of the RGB gamma data corresponding to the low-gradation of the RGB gamma data corresponding to the low-gradation has, for example, about 10% of a full-gradation.

Figure 8:
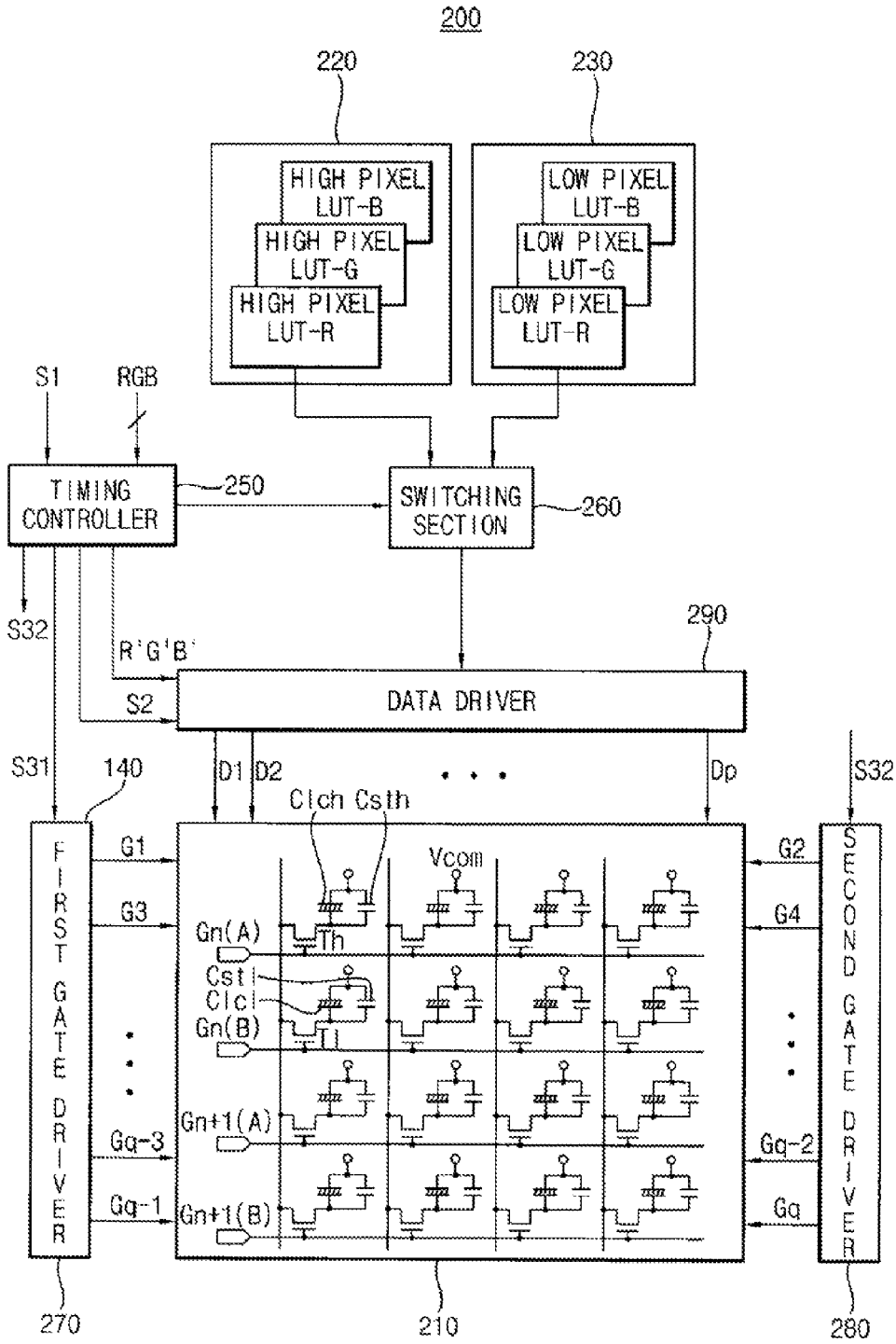
FIG. 8 is a block diagram illustrating an LCD device according to an exemplary embodiment of the present invention.

FIG. 8 is a block diagram illustrating an LCD device according to an exemplary embodiment of the present invention.

Referring to FIG. 8, an LCD device 200 according to an exemplary embodiment of the present invention may include an LCD panel 210, a first storing section 220, a second storing section 230, a timing controller 250, a switching section 260, a first gate driver 270, a second gate driver 280 and a data driver 290.

The LCD panel 210 may include a high pixel and a low pixel. The high pixel and the low pixel are formed in a pixel area defined by adjacent gate lines and adjacent data lines.

The high pixel may include a first switching element Th, a first liquid crystal capacitor Clch and a first storage capacitor Csth. The first switching element Th is electrically connected to an even-numbered gate line and an even-numbered data line. The first liquid crystal capacitor Clch and the first storage capacitor Csth are electrically connected to the first switching element Th.

The low pixel may include a second switching element Tl, a second liquid crystal capacitor Clcl and a second storage capacitor Cstl. The second switching element Tl is electrically connected to an odd-numbered gate line and an odd-numbered data line. The second liquid crystal capacitor Clcl and the second storage capacitor Cstl are electrically connected to the second switching element Tl.

The first storing section 220 stores a plurality of gamma data corresponding to the high pixel gamma curves of RGB data, respectively.

The second storing section 230 stores a plurality of gamma data corresponding to low pixel gamma curves of RGB data, respectively. Particularly, the same RGB gamma data corresponding to a low-gradation are stored in the second storing section 230. The low-gradation of the RGB gamma data corresponds to the low pixel. The low-gradation is about 10% of a full-gradation.

The timing controller 250 provided a first image signal R, G and B and a first timing signal S1 from a host system such as an external graph controller (not shown). The first timing signal S1 may include a horizontal synchronizing signal Hsync, a vertical synchronizing signal Vsync, a data enable signal DE and a main clock signal MCLK. The horizontal synchronizing signal Hsync represents a time required for displaying one line of the field. The vertical synchronizing signal Vsync represents a time required to display one frame field. Thus, the horizontal synchronizing signal Hsync includes pulses corresponding to the number of pixels included in one line. The data enable signal DE represents a time required to supply the pixel with a data.

The timing controller 250 generates a second image signal R', G' and B' based on the first image signal R, G and B, and then provides the data driver 290 with the second image signal R', G' and B' and the second timing signal S2. The second timing signal S2 includes a load signal LOAD and a start of horizontal signal STH.

The switching section 260 provides the data driver 290 with the gamma data corresponding to the RGB high pixel gamma curves and the gamma data corresponding to the RGB low pixel gamma curves in response to control the timing controlling section 250.

The first gate driver 270 provides the even-numbered gate lines GL1, GL3, . . . , GLq−3 and GLq−1 of the LCD panel 210 with first gate signals G1, G3, . . . , Gq−3 and Gq−1 that activate the even-numbered gate lines GL1, GL3, . . . , GLq−3 and GLq−1 in response to a third timing signal S31 that is provided from the timing controller 250. The third timing signal S31 includes a first gate clock signal Gate Clk1 and a first start of vertical signal STV1.

The second gate driver 280 provides the odd-numbered gate lines GL2, GL4, . . . , GLq−2 and GLq of the LCD panel 210 with second gate signals G2, G4, . . . , Gq−2 and Gq that activate the odd-numbered gate lines GL2, GL4, . . . , GLq−2 and GLq in response to a fourth timing signal S32 that is provided from the timing controller 250. The fourth timing signal S32 includes a second gate clock signal Gate Clk2 and a second start of vertical signal STV2.

The data driver 290 compensates the second image signals R', G' and B' provided from the timing controller 250 using the RGB gamma data corresponding to the high pixel and the RGB gamma data corresponding to the low pixel in response to the second timing signal S2 that is provided from the timing controller 250.

The data driver 290 transforms each of the compensated second image signals R', G', B' into a plurality of data voltages D1, D2, . . . , Dp−1 and Dp, and outputs the transformed data voltages D1, D2, . . . , Dp−1 and Dp to the data lines DL, respectively. The data voltages D1, D2, . . . , Dp−1 and Dp have a relatively inverting polarity for a polarity of a common voltage Vcom.

For example, when a polarity of the common voltage is a low level, a polarity of the data voltages D1, D2, . . . , Dp−1 and Dp is a high level with respect to the common voltage Vcom. Alternatively, when a polarity of the common voltage is a high level, a polarity of the data voltages D1, D2, . . . , Dp−1 and Dp is a low level with respect to the common voltage Vcom.

The LCD device 200 may include a power generating section (not shown) that provides the first and second gate drivers 270 and 280 with gate on/off voltages VON/VOFF in response to a fifth timing signal (not shown) provided from the timing controller 250.

The power generating section provides a common voltage Vcom to the first and second liquid crystal capacitors Clch and Clcl of the LCD panel 210 in synchronize with the gate signals G1, G2, . . . , Gq−1 and Gq.

As described above, in the LCD device having two sub-pixels corresponding to two gamma curves, respectively, that are the high pixel gamma curve and the low pixel gamma curve, corresponding to two sub-pixels to enhance a visibility of the LCD device, RGB gamma data corresponding to each high and low pixels is independently controlled, so that it is prevented from being a difference of a color coordinate value of gradations.

Particularly, each of RGB gamma curves corresponding to a low-gradation of the low pixel gamma curve are matched, so that a yellowish that is observed at a side of the LCD device is removed, which is due to a difference of a color coordinate value of gradations of the side and front of the LCD device. Therefore, it is prevented from occuring a display error.

Although the exemplary embodiments of the present invention have been described herein with reference to the accompanying drawings, it is to be understood that the present invention should not be limited to those precise embodiments and that various other changes and modifications can be affected therein by one ordinary skilled in the related art without departing from the scope or spirit of the invention. All such changes and modifications are intended to be included within the scope of the invention as defined by the appended claims.

What is claimed is:

1. A display device comprising;

a display panel having a high pixel and a low pixel, wherein the high pixel and the low pixel are formed in a pixel area; and a driving section receiving a first image signal from an external device, outputting a second image signal to the high pixel by using gamma data that corresponds to a high pixel gamma curve, and outputting a third image signal to the low pixel by using gamma data that corresponds to a low pixel gamma curve, wherein the driving section outputs the third image signal to the low pixel by using the same gamma data for each of RGB data that corresponds to a low gradation of the low pixel gamma curve, and the driving section outputs the third image signal to the low pixel by using gamma data different from each other for each of RGB data that corresponds to remaining gradations except for the low gradation of the low pixel gamma curve.

2. The display device of claim 1, wherein the driving section comprises:

a timing controller generating the second and third image signals based on the first image signal;

a gate driver outputting a plurality of gate signals to activate a plurality of gate lines; and a data driver compensating the second image signal that is provided from the timing controller by using the gamma data that corresponds to the high pixel gamma curve, compensating the third image signal that is provided from the timing controller by using the gamma data that corresponds to the low pixel gamma curve, and outputting the compensated second and third image signals to the display panel.

3. The display device of claim 2, further comprising a storing section storing the RGB gamma data corresponding to the high pixel and the RGB data corresponding to the low pixel, wherein the timing controller generates the second image signal by using the RGB gamma data corresponding to the high pixel, and generates the third image signal by using the RGB data corresponding to the low pixel.

4. The display device of claim 2, wherein the pixel area is defined by two adjacent gate lines, an odd numbered data line and an even numbered data line that is adjacent to the odd numbered data line.

5. The display device of claim 4, wherein the high pixel comprises;

a switching element electrically connected to one gate line of the two adjacent gate lines and to the even numbered data line; and a liquid crystal capacitor electrically connected to the switching element.

6. The display device of claim 5, wherein the low pixel comprises:

a switching element electrically connected to a remaining gate line of the two adjacent gate lines and to the odd numbered data line; and a liquid crystal capacitor electrically connected to the switching element.

7. The display device of claim 1, wherein the driving section comprises:

a timing controller generating the second image signal based on the first image signal;

a first gate driver outputting a plurality of gate signals to activate even-numbered gate lines;

a second gate driver outputting a plurality of gate signals to activate odd-numbered gate lines; and a data driver outputting the second image signal provided from the timing controller to the display panel.

8. The display device of claim 7, further comprising a storing section storing a high RGB gamma data corresponding to the high pixel and a low RGB gamma data corresponding to the low pixel, wherein the driving section further comprises a switching section outputting the high RGB gamma data and the low RGB gamma data to the data driver in response to a controlling of the timing controller.

9. The display device of claim 8, wherein the data driver compensates the second image signal using the high RGB gamma data and the low RGB gamma data, and outputs the compensated high RGB gamma data and the compensated low RGB gamma data to the display panel.

10. The display device of claim 9, wherein the pixel area is defined by two adjacent gate lines and adjacent two data lines, the high pixel comprises, a first switching element electrically connected to an even-numbered gate line corresponding to the first gate driver; and a first liquid crystal capacitor electrically connected to the first switching element.

11. The display device of claim 10, wherein the low pixel comprises:

a second switching element electrically connected to an odd-numbered gate line corresponding to the second gate drive; and a second liquid crystal capacitor electrically connected to the second switching element.

12. The display device of claim 1, wherein RGB gamma curves corresponding to the low gradation of the low pixel gamma curve match with each other.

* * * * *